United States Patent [19]

Kiecker et al.

[11] Patent Number: 4,982,871

[45] Date of Patent: Jan. 8, 1991

[54] GASTIGHT CONTAINER FOR WARM STORAGE AND TRANSPORT

[75] Inventors: Manfred Kiecker, Huerth; Dieter Torke; Ludwig Lange, both of Bruehl, all of Fed. Rep. of Germany

[73] Assignee: Degussa Aktiengesellschaft, Frankfurt am Main, Fed. Rep. of Germany

[21] Appl. No.: 406,059

[22] Filed: Sep. 12, 1989

[30] Foreign Application Priority Data

Sep. 17, 1988 [DE] Fed. Rep. of Germany ..... 8811839

[51] Int. Cl.[5] ..... B22C 21/00

[52] U.S. Cl. ..... 220/426; 220/649

[58] Field of Search ..... 220/426, 420, 428, 466, 220/469

[56] References Cited

U.S. PATENT DOCUMENTS

| | | | |
|---|---|---|---|
| 2,686,109 | 8/1954 | Moule | 220/426 X |
| 2,708,436 | 5/1955 | Foster | 220/426 X |
| 2,968,163 | 1/1961 | Beckman | 220/426 X |
| 2,995,268 | 8/1961 | Kurtovich | 220/426 |
| 3,097,084 | 7/1963 | Putman | 220/420 X |
| 3,952,531 | 4/1976 | Turner | 220/426 X |
| 4,055,465 | 10/1977 | Lemercier | 220/468 X |
| 4,105,061 | 8/1978 | Tunnicliffe | 220/426 X |

FOREIGN PATENT DOCUMENTS

| | | | |
|---|---|---|---|
| 2612635 | 10/1977 | Fed. Rep. of Germany | 220/469 |
| 1230587 | 5/1986 | U.S.S.R. | 220/426 |
| 1353968 | 11/1987 | U.S.S.R. | 220/466 |
| 1107797 | 3/1968 | United Kingdom | 220/420 |

*Primary Examiner*—Joseph Man-Fu Moy

*Attorney, Agent, or Firm*—Beveridge, DeGrandi & Weilacher

[57] ABSTRACT

A gastight container and method are disclosed for the storage, transport and, optionally, the sedimentation of substances which are solid at room temperature and which can be introduced in or out in a molten state under a vacuum or, preferably, under protective gas, especially of lithium metal which may contain solid impurities in the melt. The container has cylindrical middle section and a lower and an upper dished end provided with a manhole. A double jacket (2), (3) defines a space (1) for receiving sodium as heat-transfer medium.

10 Claims, 1 Drawing Sheet

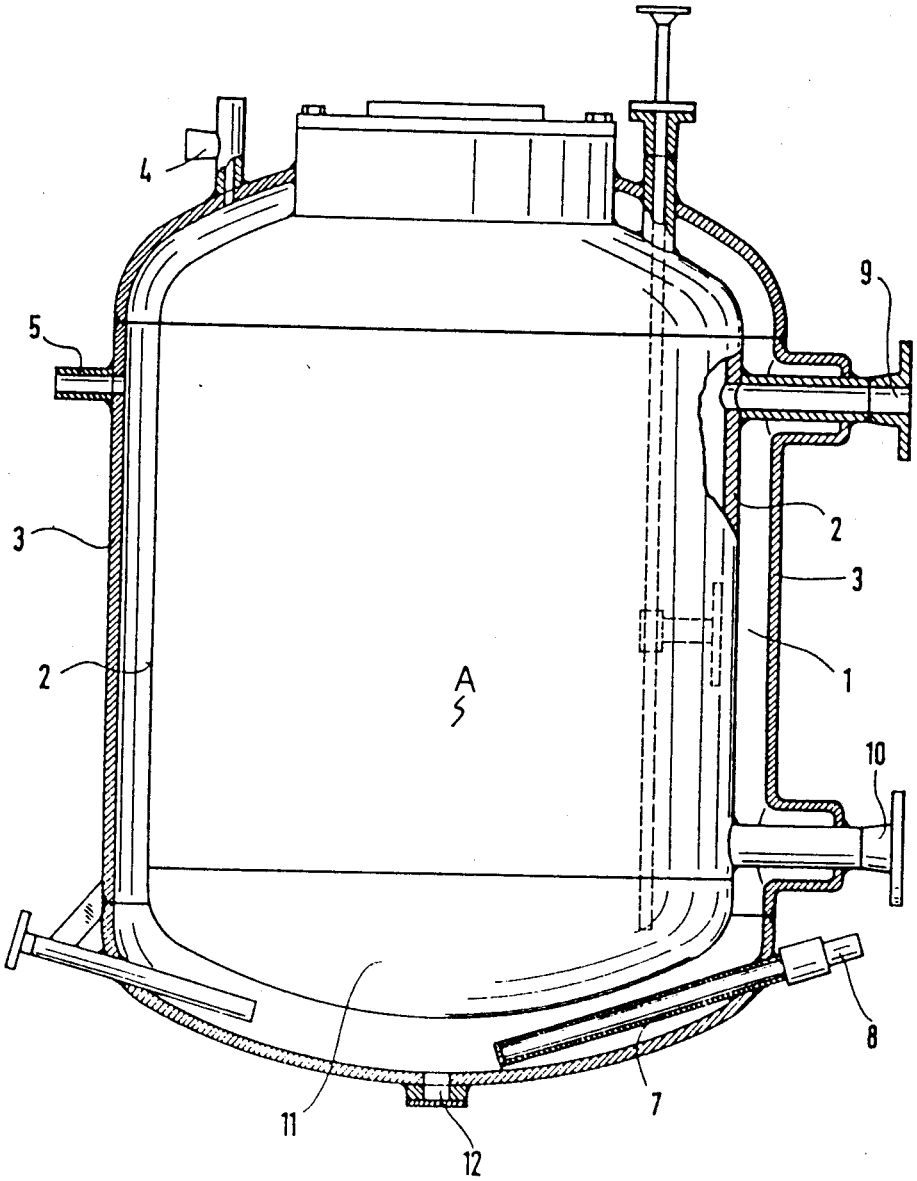
4
5
3
2
A
9
2
3
1
10
8
7
11
12

GASTIGHT CONTAINER FOR WARM STORAGE AND TRANSPORT

INTRODUCTION AND BACKGROUND

The present invention relates to a container which can be closed in a gastight manner for the storage, transport and, optionally, the sedimentation of substances which are solid at room temperature and can be introduced in or taken out in a molten state under a vacuum or, preferably, under protective gas. In particular, the container is for handling lithium metal which optionally contains solid impurities in the melt. The container of the invention is provided with a cylindrical middle section and a lower and an upper dished container end which has a manhole. The present invention also relates to the process of using the described apparatus.

The purpose of the invention is to be able to maintain such a container sufficiently warm in a broad temperature range between room temperature and 600° C. under the condition of a minimum temperature difference between the location of the associated heat source for the container and the most distantly removed container surfaces.

Up to the present, molten alkali metals, for example, such as sodium or lithium were produced according to the fusion electrolysis process and maintained in liquid condition in containers until they were subsequently formed into solid blocks. The necessary heating energy was supplied to these containers either by heat exchange oil or by heating elements attached to the outside of the container wall.

This type of energy supply has several disadvantages. When oil is used as heat exchange medium, the engineering expense for operating the oil circulation system is very high. When the oil temperature is changed, especially when the heating and cooling device is turned on and off, expansions on the flanges of cooling jackets and lines cause leaks from which oil drips. The problems which occur, especially in the area of operational safety, are so significant that industrial standard regulations such as the VDI and DIN had to be issued. Moreover, tempering operations are possible only up to a certain limiting temperature. The highest temperature at which a container can be heated in a practical manner with heating oil is approximately 350° C. A constant purification of the heating circuits is necessary on account of the cracking of the heat exchange oil.

The use of associated electrical heating apparatus, e.g. by means of heating elements, heating mats or heating muffs attached to the outside of the container is expensive in respect of installation and maintenance. When such a container is cleaned on the inside and the outside with water or solvents, the associated heating apparatus must be dismantled and then reassembled.

SUMMARY OF THE INVENTION

The present invention has for an object developing a container which can be tempered and operated in a temperature range between room temperature and 600° C. It is a further object to provide a container in which the temperature difference over the entire heating surface, that is, the temperature difference between the location of the heating source and the further-removed parts of the heating surface is minimum.

A feature of the present invention resides in a container which can be closed in a gastight manner for the storage, transport and, optionally, the sedimentation of substances which are solid at room temperature and which can be introduced into or taken out of the container in a molten state under a vacuum or, preferably, protective gas. Especially in the case of lithium metal which optionally contains solid impurities in the melt, the present invention provides a container with a cylindrical middle section and a lower and an upper dished container end provided with a manhole. A further feature of the invention resides in the process of operating the container apparatus.

BRIEF DESCRIPTION OF DRAWING

The drawing is a schematic cross sectional elevation view of a container of the invention.

DETAILED EMBODIMENT OF THE INVENTION

The new container is characterized by a double jacket wall (2), (3) which defines an internal space (1) for receiving sodium as heat transfer medium. The jacket defined by the internal space surrounds the inside container space (11). Fitted to the outer jacket wall (3) is a filling and ventilation connection (4) as well as an overflow connection (5) for the sodium. Several casings or tubes (7) are arranged in a star-shaped pattern, introduced through the outer jacket of the lower dished container end into the space (1) and provided in the interior of said casing tubes with electrical heating rods (8) to provide heating means to heat the internal space and contents thereof. Infeed and removal connections (9) and (10) respectively, are provided for the material to be stored or transported and extend through the double jacket on the side of the cylindrical middle section adjacent to the ends or shoulders of the dished upper and lower container ends. An outlet connection (12) for the sodium is located at the lowest point of the lower dished container end. The section (11) is located below the connection (10) to optionally receive sediment.

The tempering arrangement device of the container in accordance with the invention therefore comprises a jacket placed at a determined distance around the container wall to define a space between the inside container wall (2) and the jacket wall (3). Heating means (8) are located in the lower area of the double jacket in the form of replaceable heating rods surrounded by protective tubes.

The hollow space of the double jacket is filled up to about 90% of its capacity with an alkali metal, preferably sodium, as the heat conductor or heat distributor medium. The hollow space still remaining at the top within the space (1) in the container is evacuated so that a cubical expansion of the sodium heating conduction medium can not cause an undesirable rise in pressure in the gas space. This hollow space runs up to the block flange of the manhole located in the middle of the upper dished boiler end. Connected into the hollow space, as shown in the drawing are the following: a filling connection (4), ventilation connection (4), overflow connection (5) and removal connection (12). Preferably, the filling connection and the ventilation connection are combined. The filling connection, ventilation connection and overflow connection are located in the upper area of the hollow space whereas the removal connection is situated at the lowest point of the jacket space. All connections are welded in a gastight manner after the sodium has been put in. The double-jacketed hollow space preferably surrounds all connections of this container at least partially.

The heating source of the new heat-retaining system consists of 6 heating rods located in a star-shaped pattern in the lower double domed container end. These heating rods are inserted into protective tubes welded into place free of tension so that individual rods can be replaced or removed during operation for cleaning. The temperature of the heat-conducting medium, preferably sodium, is monitored both in the area of the domed container end as well as in the cylindrical part of the double-jacketed hollow space.

An illustrative description of the operation of the subject matter of the present invention is presented in the following with reference made to the accompanying drawing.

In order to fill the storage or transport container with the product contents, i.e. lithium as intended, the tempering system of the container means is adjusted to the desired temperature (which is 220° C. for storing lithium under inert gas) and the double jacket (2), (3) which contains the sodium heating medium appropriately heated by heating rods (8). After a visual check of the interior of the holding container means for cleanliness, the container is evacuated in a gastight manner via a connection located on the container top (not shown) and filled with an inert gas of conventional type. The process of evacuation and of filling with inert gas is repeated until the atmosphere in the container is free of nitrogen, oxygen and water vapor.

After the desired temperature for liquification of the lithium (220° C.) has been reached in sodium heating medium space (1) and in the holding space for the product (A), the lithium product to be stored in a liquid fashion can either be drawn in by suction through infeed connection (9) or, if the inert gas volume displaced by the lithium volume is suitably removed, it can be introduced into the container without pressure in a free inflow in the same way.

The temperature of the stored material is measured by a temperature probe extending into space (11) in the lower domed container end.

The liquid storage of the particular product provided, especially of lithium, can take place in an absolutely reliable manner by means of the uniform heating of the container made possible by the present invention to temperatures above the melting point of the product. If a recrystallization of the product is to take place by allowing it to solidify and melting it, this can be carried out by means of the sodium heat-conducting medium without the appearance of temperature differences on all heated wall surfaces, in contrast to the locally point-focused heating or overheating phenomena if a conventional electric heating apparatus attached to the container wall is used.

It is precisely the local overheating on the inner container wall which can not be avoided with the previous conventional heating apparatus which result especially in the case of lithium in a reaction between this aggressive element and individual components of the container material. A removal of carbon and optionally of other alloy components from the metal container walls which occurs thereby can result in dangerous stress corrosion cracking.

For routine emptying in a normal operation, the lithium is removed from the container with the customary technology. e.g. suction or pressure means or being allowed to run off via connection 10. For a complete emptying of the container for cleaning purposes, liquid and/or solid remnants of the product located in the lower domed container end can be easily scooped out or scraped out under a charge of argon protective gas from above through the manhole.

The uniform heating of the entire container wall, that is, the holding means surface, permits the control of a temperature for the lithium contents which is just above its melting point and at which the reactivity of lithium to oxygen, nitrogen and the water vapor of the air can be reduced to the extent that the metal can be transferred in air into a collection vessel without the autoignition which is otherwise observed to occur. The present invention therefore constitutes a decisive contribution to improving safety in the handling of lithium.

Further variations and modifications of the foregoing will be apparent to those skilled in the art and are intended to be encompassed by the appended claims.

German priority application G 88 11 839.8 is relied on and incorporated by reference.

We claim:

1. A container for storage and transport of molten metals which may contain solid impurities comprising:
   - a cylindrical middle section having lower and upper dished container ends, wherein a holding space is defined;
   - a double jacket defining a heat-transfer space, said jacket at least partially surrounding said holding space, for receiving a liquid heat-transfer medium;
   - a ventilation connection through said double jacket;
   - a heat-transfer medium filling connection for introducing said heat-transfer medium into said heat transfer space;
   - a plurality of heat rod casings projecting into the heat-transfer space, whereby heat is transferred to the heat-transfer medium from a heat source which is placed in said casings;
   - an inlet and an outlet for introducing the molton metal into said holding space; and
   - an outlet connection for removing the heat-transfer medium from said heat-transfer space.

2. A container as defined in claim 1, further including a manhole through said upper dished container end.

3. A container as defined in claim 1, further including a heat-transfer medium overflow connection.

4. A container as defined in claim 1, further including a sediment collection section located in the lower dished container end.

5. A container as defined in claim 1, further including electrical heating rods inserted into said casings.

6. A container as defined in claim 1, further including a probe extending into said holding space.

7. A container as defined in claim 6, wherein said probe is a temperature probe.

8. A container as defined in claim 1, wherein the ventilation connection and the heat-transfer medium filling connection are combined into a single connection.

9. A container as defined in claim 1, wherein the molten metal being stored and transported is liquid lithium which may contain solid impurities.

10. A container as defined in claim 1, wherein the heat-transfer medium is sodium.

* * * * *